United States Patent [19]

Robinson

[11] 4,295,816

[45] Oct. 20, 1981

[54] CATALYST DELIVERY SYSTEM

[76] Inventor: B. Joel Robinson, 501 Boylston St., Brookline, Mass. 02146

[21] Appl. No.: 163,865

[22] Filed: Jun. 27, 1980

Related U.S. Application Data

[63] Continuation of Ser. No. 862,411, Dec. 20, 1977, abandoned.

[51] Int. Cl.[3] ..... F23J 7/00

[52] U.S. Cl. ..... 431/4; 123/1 A

[58] Field of Search ..... 431/4, 126, 354; 44/54; 208/120, 160; 252/441, 442; 123/1 A

[56] References Cited

U.S. PATENT DOCUMENTS

| | | | |
|---|---|---|---|
| 2,194,186 | 3/1940 | Pier | 252/441 |
| 2,460,700 | 2/1949 | Lyon | 123/1 A |
| 3,862,819 | 2/1975 | Wensworth | 431/4 |
| 4,008,037 | 2/1977 | Hindin | 431/4 |
| 4,014,637 | 3/1979 | Schewa | 431/4 |
| 4,064,037 | 12/1977 | Graven | 208/120 |
| 4,064,039 | 12/1977 | Pewick | 208/160 |
| 4,111,641 | 9/1978 | Morrison | 431/4 |
| 4,133,628 | 1/1979 | Morrison | 431/4 |
| 4,170,960 | 10/1979 | Germack | 123/1 A |
| 4,214,615 | 7/1980 | Boyer | 123/1 A |

FOREIGN PATENT DOCUMENTS

| | | | |
|---|---|---|---|
| 767839 | 5/1971 | Belgium | 431/4 |

OTHER PUBLICATIONS

Chester, Schwartz, Stover, McWilliams, "CO Oxidation Promoters in Catalytic Cracking", Mobil R&D Corp., Paulsboro, N.J. 08066, Apr. 1979.

*Primary Examiner*—Albert W. Davis

*Attorney, Agent, or Firm*—Milton Oliver; David Warren

[57] ABSTRACT

A system for delivering a catalyst into a forced draft entry port of a chemical reaction chamber, such as a fossil fuel combustion chamber, includes a container having an aqueous solution of the catalyst. A suction line extends from an air space above the solution to the entry port. An intake line at atmospheric pressure enters the container and has an end submerged below the surface of the aqueous solution, the submerged end having a float for maintaining the end at a predetermined distance below the surface and thereby establishing a predetermined back pressure. A layer of oil floats on top of the aqueous solution and may contain a second dissolved catalyst. Air from the intake line bubbles up through the aqueous solution and the oil layer absorbing minute quantities of of the catalysts which are carried by the air into the reaction chamber. Platinum and manganese catalysts improve the efficiency of fossil fuel combustion such as that of the home oil burner.

6 Claims, 4 Drawing Figures

CATALYST DELIVERY SYSTEM

This is a continuation of application Ser. No. 862,411, filed Dec. 20, 1977 now abandoned.

BACKGROUND OF THE INVENTION

Water has been used to improve fossil fuel combustion in both automotive engines and oil fired furnaces. In the case of automotive engines, wherein gasoline is burned in air, the air has been mixed with water to increase its humidity prior to the mixing of the gasoline with the air. In the case of oil fired furnaces, steam has been used to atomize the oil. Various techniques have been used for the mixing of water with the constituent substances of the combustion process. These techniques include the spraying of water into a chamber of air as taught in U.S. Pat. No. 3,107,657 which issued in the name of D. Cook, the passing of water through gasoline as taught in U.S. Pat. No. 3,724,429 which issued in the name of N. Tomlinson, the forcing of a stream of fine bubbles of air through water as taught in U.S. Pat. No. 3,767,172 which issued in the name of H. Mills, and the injection of a fine spray of water into a gas flame as taught in U.S. Pat. No. 3,809,523 which issued in the name of W. Varekamp. A more recent technique, taught in U.S. Pat. No. 3,862,819 which issued in the name of F. Wentworth, involves the diversion of a small portion of the inlet air to a combustion chamber, and bubbling the air through water covered with a layer of oil.

A problem arises with the techniques taught by the first four of the aforementioned patents in that they require the continuous replenishment of the water supply. While water use has been reduced in the system of the aforementioned Wentworth patent, it is desirable to increase the efficiency of the combustion to a greater extent than that provided by Wentworth. Also, as noted by Wentworth, the systems of the first four of the aforementioned patents with the larger use of water may cause damage as the shortening of the life of an automobile engine.

SUMMARY OF THE INVENTION

In accordance with the invention, the aforementioned problems are overcome and still other advantages are provided by a system incorporating one or more catalysts which are dissolved in liquids through which a gas is bubbled for subsequent passage into a chamber wherein a chemical reaction, such as the combustion of a fossil fuel, takes place. In a preferred embodiment of the invention utilized for the delivery of minute quantities of water containing a catalyst to the oil burner of a furnace, the system of the invention comprises a flask containing water in which has been dissolved a catalyst, a chloride of platinum. A petroleum based oil layer is floated on top of the water. A second catalyst, manganese naphthanate, which is insoluble in water is dissolved in the oil. The oil burner has a forced air intake port to which is attached a suction line from an air space in the flask above the layer of oil. An intake line brings air at atmospheric pressure into the flask, an end of the intake line being submerged below the surface of the water to provide for the bubbling of air through the water and oil in response to suction of the suction line. A float is attached to the suction line for floating the end of the suction line at a predetermined depth to establish a predetermined back pressure, whereby the bubbling is regulated by the difference between the suction pressure and the atmospheric pressure independently of the depth of the water. The dissolving of the platinum and manganese catalysts provides for a fine dispersion of the catalysts at the molecular level which permits the absorption of minute quantities of finely dispersed catalyst into the air bubbles. Intimate mixing of the catalysts with the constituent components of the combustion process is thereby attained. The flask with its floating inlet line and outlet suction line may be used for other catalysts, and liquids other than water, such as alcohol, may be utilized. Barium may also be utilized in addition to the aforementioned platinum and manganese as a combustion catalytic metal. While other halogen compounds of platinum, such as platinum tetrabromide, may be utilized, the preferred embodiment has employed dihydrogen-platinum hexachloride which decomposes at 115° C. The decomposition is believed to make molecular platinum available to the burning fuel, thereby enhancing the combustion. Thus, it is seen that platinum metal has been combined with chlorine, dissolved in water, carried off by air, and released as a metal at the combustion site at a temperature lower than the combustion temperature.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
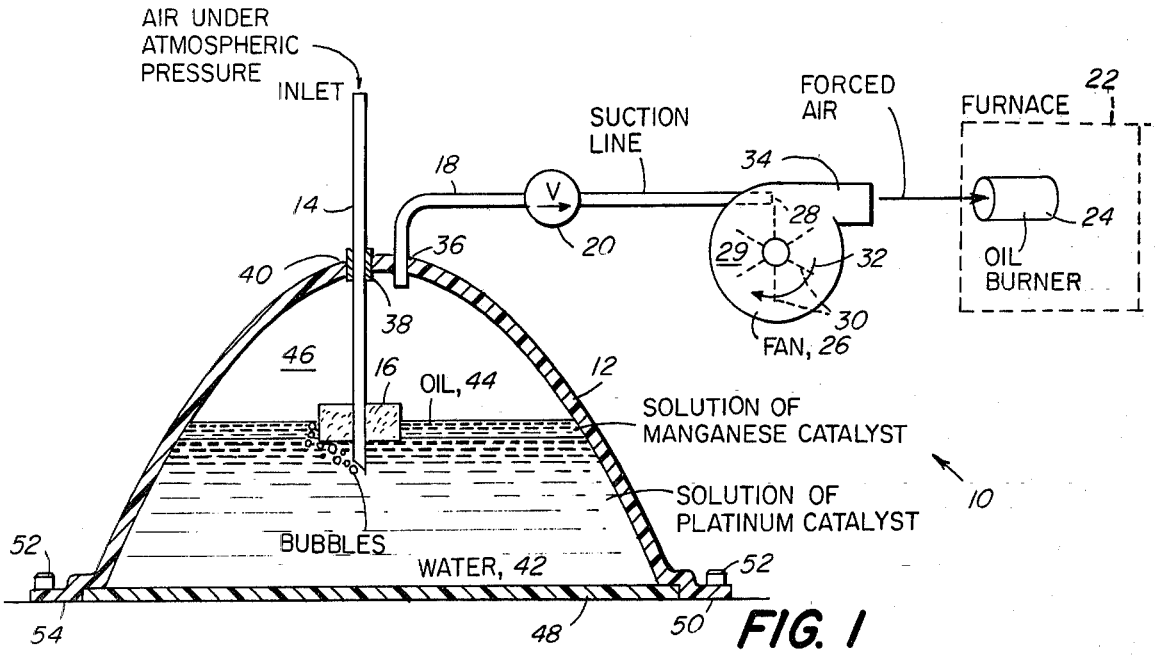
FIG. 1 is a diagrammatic illustration of a catalyst delivery system in accordance with the invention.

Referring now to FIG. 1, a catalyst delivery system 10, in accordance with the invention, comprises a flask 12, a tube 14 having a float 16 positioned near the lower end thereof, a tube 18 having a shut-off valve 20, a furnace 22 with an oil burner 24 therein, and a centrifugal fan 26 which forces air into the burner 24. The tube 18 has an end 28 which is passed through an aperture in the housing 29 of the fan 26, the end 28 facing in the downstream direction of the air flow thereby inducing suction in the tube 18. Vanes 30 rotate in the direction of the arrow 32 to draw air in at the port 32 and discharge the air via port 34. The tube 18 serves as an outlet of the flask 12 and is secured at an aperture 36 of the flask 12. The tube 14 is slidably secured to the flask 12 by a tube segment 38 which is fixedly secured to an aperture 40 of the flask 12. The upper end of the tube 14 is open to the atmosphere.

The flask 12 is partially filled with water 42 with a layer of oil 44 placed on top of the surface of the water. The suction of the tube 18 reduces the pressure of the air in the space 46 above the oil 44 and water 42 resulting in a lowering of the water level in the tube 14. The float 16 maintains the bottom end of the tube 14 a predetermined distance below the surface of the water. The position of the float 16 on the tube 14 is adjusted so that the back pressure of the column of water in the tube 14 is less than the suction in tube 18 with the result that atmospheric air is drawn down through the tube 14 and bubbles up past the float 16 and into the space 42. The bubbles of air absorb minute quantities of water vapor and oil as well as substances dissolved therein. In particular, soluble compounds of metals, such as platinum and manganese which serve as catalysts in combustion reactions, are dissolved in the water 42 and in the oil 44.

In accordance with the invention, the dissolving of catalysts in the liquids contained in the flask 12 provides a fine dispersion of the catalysts such that molecules of the catalysts can be carried off by the air of the bubbles and, then, via the air in the tube 18 to the combustion region within the furnace 22. In this connection, it is noted that the substances in the liquids of the flask 12 may be absorbed into the air in the manner of absorbing water vapor to make humid air, or alternatively, the substances may be suspended in the air such as aerosols or droplets of water in a fog. The absorption at the molecular level is preferred since it permits the metering of minute quantities of the catalysts in precisely the amount desired without any wasting of the catalyst. In contrast, the suspension of aerosols of the catalyst is wastefull since far more catalyst is consumed than is required. In addition, the suspension of aerosols consumes much of the water so that refilling of the flask 12 is required at much more frequent intervals.

The viscosity of the liquid is an important factor in limiting the production of aerosols from the bursting of bubbles at the interface of the liquid and the air. Thus, while a liquid of lower viscosity such as water permits vigorous bubbling and the consequent splattering and formation of aerosols, a viscous liquid such as heavy oil permits no more than a gradual movement of bubbles without the spattering and formation of aerosols. The layer of oil 44 has sufficient viscosity to insure that no splattering of either the oil 44 or water 42 occurs with the consequent conservation of the liquids, the oil 44 and water 42, and the catalysts dissolved therein.

The flask 12 is made of a rigid material impervious to the liquids contained therein. In the case of the preferred embodiment wherein oil and water are contained within the flask 12, the flask 12 may be made of glass or, preferably, of a shatter resistant plastic such as that of a polycarbonate resin marketed under the name of Lexan. The float 16 is in the form of a right circular cylinder made of foamed polyurethane, and has an aperture thereinfor the passage of the tube 14. In assembling the flask 12, the float 16 is first positioned on the tube 14, and then the tube 14 is passed through the open bottom of the flask 12 and slid through the tube segment 38. A cover plate 48 is then adhesively secured to a rim 50 around the bottom edge of the flask 12. Bolts 52 pass through a flange 54 of the flask 12 for securing the flask 12 to a mounting surface such as the floor of a furnace room. The lower end of the tube 14 is cut at an angle of approximately 45 degrees to permit bubbling even in the case wherein the bottom end of the tube 14 is near to or in contact with the cover plate 48. The cover plate 48, the tubes 14 and 18, and the tube segment 38 are all advantageously constructed of the same material used in making the flask 12.

The tube segment 38 has a length of one inch and an inside diameter of 0.750 inch. The tube 14 has an inside diameter of $\frac{5}{8}$ inch. The outside surface of the tube 14 is ground to provide an outside diameter of 0.748 inch which gives 0.001 inch clearance around the tube 14. Thereby, there is a sufficiently snug fit between the tube 14 and the tube segment 38 to permit no more than a negligible amount of air to pass between the tube 14 and the tube segment 38 while permitting the tube 14 to slide within the tube segment 38. The flask 12 has a paraboloidal shape with a height of nine inches and a base diameter of sixteen inches. A sheet of $\frac{1}{8}$ inch thickness of Lexan has been used in fabricating the flask 12. The diameter of the tube 18 may be equal to that of the tube 14, or slightly smaller such as $\frac{1}{2}$ inch outside diameter.

Figure 2:
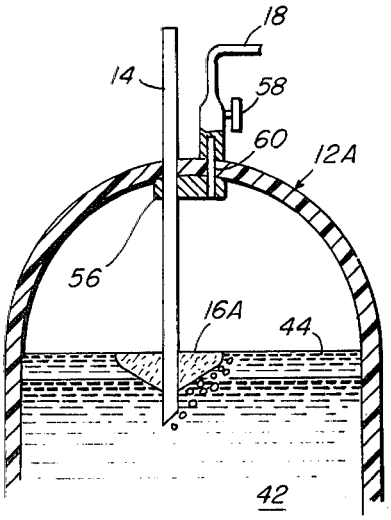
FIG. 2 shows an alternative embodiment of the top portion of a flask of FIG. 1.

Referring now to FIG. 2, there is seen an alternative embodiment of the top portion of the flask 12 of FIG. 1, identified by the legend 12A, the figure also showing an alternative form of the float identified by the legend 16A. A plate 56 of the same material as is utilized in making the flask 12A is adhesively secured to the inner surface of the top of the flask 12A. A valve 58, such as the shut off valve 20 of FIG. 1, is secured by a section of pipe 60 having a $\frac{1}{2}$ inch pipe thread to the plate 56. Instead of grinding the outer surface of the tube 14, the diameter of the tube 14 is retained at 0.750 inch, and the plate 56 is provided with an aperture which is reamed to 0.752 inch. The resulting clearance is the same as that described above for the flask 12 of FIG. 1. The float 16A is seen in a sectional view wherein the lower edge is curved to provide for a smooth flow of bubbles around the float 16A.

Figure 3:
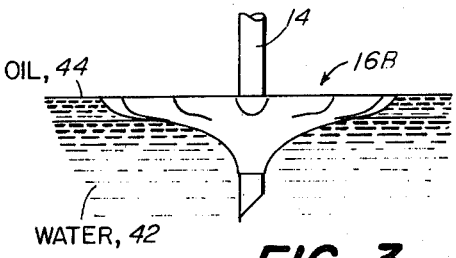
FIGS. 3 and 4 show, respectively, a side view and a plan view of an alternative embodiment of a float of FIG. 1.
Figure 4:
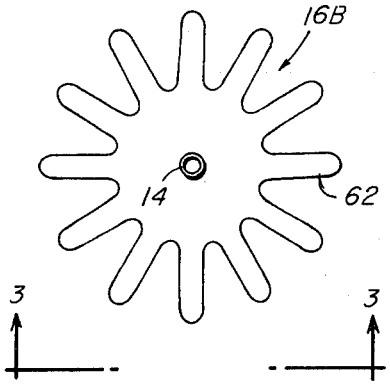

Referring now to FIGS. 3–4, there is seen an alternative embodiment of the float 16 of FIG. 1, this alternative embodiment being identified by the legend 16B. The bottom surface of the float 16B curves gently upwards toward the top surface for promoting a smooth flow of the bubbles. A set of spurs 62 is positioned about the periphery of the float 16B with the spurs 62 directed radially outward for retarding the propagation of bubbles through the oil 44 and thereby inhibiting any splattering. Thus, both the increased viscosity of the oil 44 and the physical structure of the float 16B coact to inhibit splattering and the formation of aerosols of water and oil.

Referring also to FIG. 1, it is seen that the time of propagation of a bubble through the layer of oil 44 depends on the thickness of the layer of oil and may be adjusted by adding or deleting a quantity of the oil. The propagation time within the water may be increased by enlarging the diameter of the float so as to lengthen the path through which the bubbles flow. In this way, the relative amounts of oil, water, and catalysts dissolved therein may be regulated. Oil such as that utilized in two-cycle gasoline engines has been utilized effectively for the layer of oil 44. Catalysts such as platinum and manganese have been utilized. Chloride and naphthanate have been utilized for forming solutions, respectively, in water and oil. Thus, dihydrogenplatinum hexachloride dissolves in the water and manganese naphthanate dissolves in the oil. The rate of absorption of the catalysts into the air carried by the tube 18 is proportional to the bubbling rate which is regulated by the height of the column of water in the tube 14. The height of the column of water is preset by the aforementioned venting of the tube 14 to the atmosphere and the position of the float 16 relative to the end of the tube 14. Upon initial installation of the tube 14, the float 16 is positioned high up on the tube 14 and, the oil and water are then poured in through the top end of the tube 14. After the oil and water have reached their equilibrium positions, and after suction by the fan 26 is commenced via the tube 18, the float 16 is urged into position by withdrawing the tube 14 upwardly through the aperture in the top of the flask 12.

By way of example, in the case where the oil burner 24 burns oil at the rate of approximately 15 gallons per hour, the flask 12 is filled to a height of six inches with water 42 and the layer of oil 44 is ¼ inch deep. The concentration of the catalyst in the solution is not critical since the bubbling rate can be adjusted to provide a desired metal/fuel ratio to the flame of the burner 24. With respect to the catalyst $H_2PtCl_6 \cdot 6H_2O$, a concentration of one gram catalyst dissolved in 32 gallons of water has been used. A bubbling rate of 2–4 bubbles per second has been used.

This results in a metal/fuel ratio of no more than one part per million for platinum. Such a metal/fuel ratio would also be fully effective in the cases of palladium or rhodium catalyst. Since each part per million of platinum, for example, used adds 5% to the cost of fuel (assuming platinum at $300 per standard ounce and fuel at $.60/gallon or $.06/ounce) and fuel savings resulting from this invention approximate 20%, the invention would be economically inoperative if more than 4 ppm of platinum per unit of fuel were required. This would also be the economic ceiling for catalysts containing most other platinum group metals, except for osmium, iridium and palladium, for which 8–9 ppm would be the economic ceiling. One part per million corresponds to one milligram of metal in each kilogram of gasoline or home heating oil.

It is understood that the above-described embodiments of the invention are illustrative only and that modifications thereof may occur to those skilled in the art. Accordingly, it is desired that this invention is not to be limited to the embodiments disclosed herein, but is to be limited only as defined by the appended claims.

I claim:

1. A system for the delivery of a catalyst containing not more than 9 mg of a platinum group metal per kg of fuel to a combustion system having an intake port for air comprising:

means for dispensing said catalyst in a liquid; and means for passing a portion of said air via said liquid for absorbing said catalyst into said air.

2. A system according to claim 1 wherein said catalyst is in the form of a compound soluble in said liquid.

3. A system according to claim 2 wherein said compound includes platinum.

4. A system according to claim 3 wherein said compound decomposes upon heating.

5. A system for the delivery of a catalyst containing not more than 9 mg of a platinum group metal per kg of fuel to a combustion system having an intake port for air comprising:

a dispensing vehicle containing said catalyst; and means for passing said air via said dispensing vehicle for absorbing said catalyst into said air.

6. A method for the delivery of a catalyst containing not more than 5 mg of a platinum group metal per kg of fuel to a combustion system having an intake port for air comprising:

dispersing said catalyst in a dispensing agent; and passing said air via said dispensing agent for absorbing said catalyst into said air.

* * * * *

UNITED STATES PATENT AND TRADEMARK OFFICE

CERTIFICATE OF CORRECTION

PATENT NO. : 4,295,816

DATED : October 20, 1981

INVENTOR(S) : B. Joel Robinson

It is certified that error appears in the above—identified patent and that said Letters Patent is hereby corrected as shown below:

Under references cited, the date and patentee of Patent No. 4,014,637 should read --3/1977 Schena--. In column 3, line 23, "wastefull" should read --wasteful--. In column 6, line 26, "5 mg" should read --9 mg--. In column 6, lines 9, 22, 23, 29 and 30, "dispensing" should read --dispersing--.

Signed and Sealed this

*Thirtieth* Day of *March 1982*

[SEAL]

*Attest:*

GERALD J. MOSSINGHOFF

*Attesting Officer*

*Commissioner of Patents and Trademarks*